US005163284A

United States Patent [19]

Shekleton

[11] Patent Number: 5,163,284

[45] Date of Patent: Nov. 17, 1992

[54] DUAL ZONE COMBUSTOR FUEL INJECTION

[75] Inventor: Jack R. Shekleton, San Diego, Calif.

[73] Assignee: Sundstrand Corporation, Rockford, Ill.

[21] Appl. No.: 652,010

[22] Filed: Feb. 7, 1991

[51] Int. Cl.[5] ..... F02C 3/05; F23R 3/34

[52] U.S. Cl. ..... 60/39.36; 60/746; 60/760

[58] Field of Search ..... 60/39.36, 39.75, 39.83, 60/737-740, 743, 746, 755, 756, 758, 760; 431/354; 239/418, 432, 433

[56] References Cited

U.S. PATENT DOCUMENTS

| | | | |
|---|---|---|---|
| 2,706,520 | 4/1955 | Chandler | 60/739 |
| 3,099,134 | 7/1963 | Calder et al. | 60/752 |
| 3,613,360 | 10/1971 | Howes | 60/39.36 |
| 4,173,118 | 11/1979 | Kawaguchi . | |
| 4,499,735 | 2/1985 | Moore et al. | 60/739 |
| 4,798,190 | 1/1989 | Vaznaian et al. | 123/531 |
| 4,815,665 | 3/1989 | Haruch | 239/432 |
| 4,903,478 | 2/1990 | Seto et al. | 60/739 |
| 5,069,033 | 12/1991 | Shekleton | 60/39.36 |

FOREIGN PATENT DOCUMENTS

| | | |
|---|---|---|
| 8817859.4 | 10/1988 | European Pat. Off. . |
| PCT/US88/-04423 | 12/1988 | PCT Int'l Appl. . |

*Primary Examiner*—Richard A. Bertsch
*Assistant Examiner*—Timothy S. Thorpe
*Attorney, Agent, or Firm*—Wood, Phillips, VanSanten, Hoffman & Ertel

[57] ABSTRACT

In order to facilitate operation in a wide variety of operating conditions, and to enhance altitude starting capability while eliminating start injectors, a radial turbine engine (10) includes dual fuel injection zones (24 and 26). The radial turbine engine (10) also includes a turbine wheel (12) coupled to a rotary compressor (14) for axially driven movement, an annular nozzle (16) for directing gases of combustion radially at the turbine wheel (12), and an annular combustor (15). The annular combustor (15) defines an annular combustion space disposed about the turbine wheel (12) and in fluid communication with both the compressor (14) and the nozzle (16), and it receives fuel from a source and air from the compressor (14) which are combusted in the combustion space to generate the gases of combustion. The radial turbine engine (10) is such that the annular combustor (15) is defined by an annular outer wall (18), an annular inner wall (20), and a radial wall (22) extending between the inner and outer walls (20 and 18) axially opposite the nozzle (16). In order to achieve the objectives of the invention, the first fuel injection zone (24) is adjacent the radial wall (22) and the second fuel injection zone (26) is intermediate the first fuel injection zone (24) and the nozzle (16), and each of the fuel injection zones (24 and 26) includes a plurality of circumferentially spaced fuel injectors (28 and 30) for injecting fuel tangentially thereinto.

23 Claims, 2 Drawing Sheets

DUAL ZONE COMBUSTOR FUEL INJECTION

FIELD OF THE INVENTION

The present invention is generally directed to a fuel injection system for a radial turbine engine and, more specifically, a radial turbine engine having dual fuel injection zones.

BACKGROUND OF THE INVENTION

In small gas turbine engines, it is known to be desirable to minimize the total number of fuel injectors. It is an accepted fact that injectors are costly and, where a high number of fuel injectors is required, there will be a resulting low fuel flow per injector which means that the injectors are much more prone to clogging or plug-up. Furthermore, in many instances, small scale viscous effects deteriorate fuel atomization at reduced fuel flows.

Of course, when this exists, it is most difficult to be able to successfully achieve satisfactory or even acceptable combustion. This is a particular problem at the low fuel flow rates normally associated with high altitude starting which could otherwise be overcome if the combustor could be sized sufficiently large to provide additional time for fuel evaporation and combustion. Nevertheless, in many instances, it is impossible to provide the necessary space for utilization of a combustor of sufficient volume.

Specifically, for some applications, it might be possible to achieve high altitude starting even with low fuel flow rates. This could be accomplished, for example, by employing a large dome height and a relatively short combustor length. Unfortunately, for many applications, there are limitations on dome height that are undesirable as to operating performance.

For some such applications, the desired combustor volume might nevertheless be attainable in a different manner. This could be achieved, for example by extending the combustor length to where possible to account for the limit on dome height. However, it has been determined that this has not resulted in the desired operating characteristics.

The present invention is directed to overcoming one or more of the foregoing problems and achieving one or more of the resulting objects by enhancing performance even in those instances where a large dome height is unavailable.

SUMMARY OF THE INVENTION

It is a principal object of the present invention to provide a radial turbine engine of improved operating characteristics. It is a further object of the present invention to provide dual fuel injection zones in a radial turbine engine It is yet another object of the present invention to provide an operating system capable of prioritizing fuel flow to the dual injection zones.

Accordingly, the present invention is directed to a radial turbine engine having a turbine wheel coupled to a rotary compressor for axially driven movement thereof, an annular nozzle for directing gases of combustion radially at the turbine wheel, and an annular combustor defining an annular combustion space disposed about the turbine wheel and in fluid communication with both the compressor and the nozzle. The combustor receives fuel from a source and air from the compressor and combusts the fuel and air in the combustion space to generate the gases of combustion. The combustor is defined by an annular outer wall, an annular inner wall, and a radial wall extending between the inner and outer walls axially opposite the nozzle. Still additionally, the radial turbine engine includes means for injecting fuel tangentially into a first fuel injection zone adjacent the radial wall and means for injecting fuel tangentially into a second fuel injection zone intermediate the first fuel injection zone and the nozzle to accomplish the unique objectives of the present invention.

In a preferred embodiment, the second fuel injection zone is located axially adjacent the first fuel injection zone. The fuel injecting means advantageously comprises a plurality of circumferentially spaced fuel injectors wherein the fuel injectors associated with the first and second fuel injection zones are axially spaced apart Further, at least the fuel injectors associated with the first fuel injection zone are preferably of the fuel impingement type.

In a highly preferred embodiment, the radial turbine engine includes means for controlling the distribution of fuel from the source to the respective ones of the fuel injectors. In other words, the relative proportion of fuel which is distributed to the fuel injectors associated with the first and second fuel injection zones is purposely controlled Preferably, the controlling means includes valve means for ensuring the distribution of fuel first to the first fuel injection zone and then to the second fuel injection zone.

In another respect, the radial turbine engine may advantageously include means for injecting dilution air into a dilution air zone at a point intermediate the second fuel injection zone and the nozzle. In a highly advantageous embodiment, the dilution air zone is formed to include a first zone located adjacent the second fuel injection zone and an axially adjacent second zone immediately upstream of the nozzle. With this arrangement, the radial turbine engine preferably includes a plurality of circumferentially spaced tangential dilution air tubes and a plurality of circumferentially spaced inclined dilution air tubes.

More specifically, the tangential dilution air tubes are advantageously in the outer wall of the combustor for injecting dilution air into the first dilution air zone generally tangentially thereof. On the other hand, the inclined dilution air tubes are advantageously in the outer wall of the combustor for injecting dilution air into the second dilution air zone generally toward the nozzle.

In a most highly preferred embodiment, the controlling means includes first and second fuel manifolds associated with the fuel injectors of the first and second fuel injection zones, respectively. A fuel supply line preferably interconnects the first and second fuel manifolds and the valve means may advantageously comprise a check valve disposed in the fuel supply line. Still additionally, the controlling means preferably includes a control valve upstream of the first fuel manifold for controlling fuel flow from the source to the first fuel manifold Other objects, advantages and features of the present invention will become apparent from a consideration of the following specification taken in conjunction with the accompanying drawings.

DETAILED DESCRIPTION OF THE PREFERRED EMBODIMENT

Figure 1:
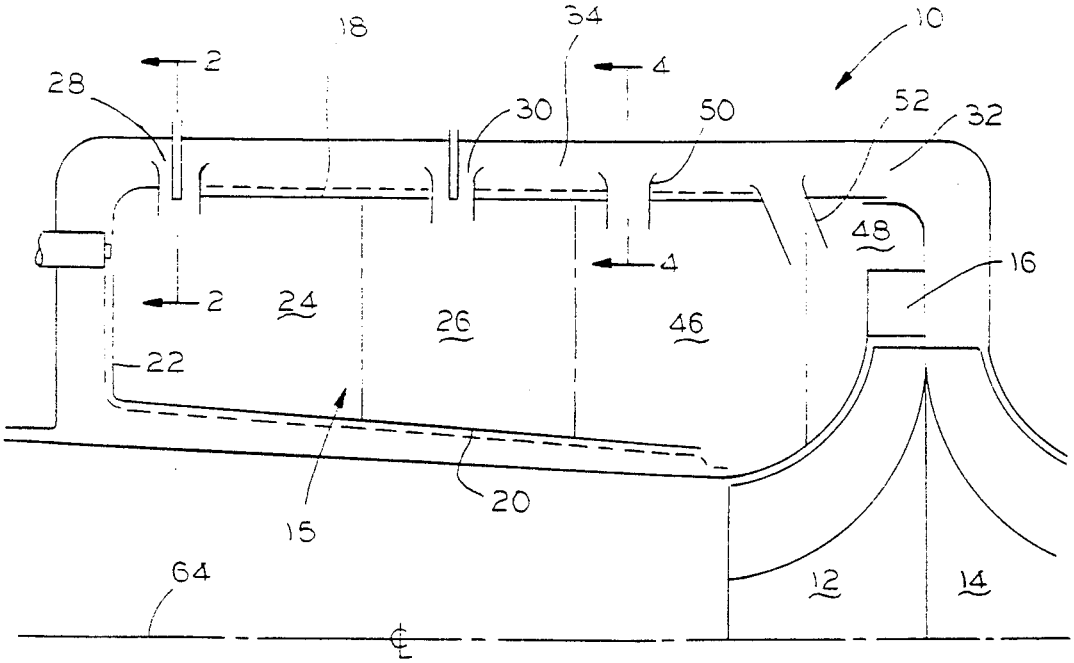
FIG. 1 is a partially schematic cross-sectional view illustrating a dual fuel injection zone radial turbine engine in accordance with the present invention.

In the illustration given, and with reference first to FIG. 1, the reference numeral 10 designates generally a radial turbine engine in accordance with the present invention. The radial turbine engine 10 includes a turbine wheel 12 coupled to a rotary compressor 14 for axially driven movement thereof, an annular nozzle 16 for directing gases of combustion radially at the turbine wheel 12, and an annular combustor generally designated 15. The annular combustor 15 defines an annular combustion space disposed about the turbine wheel 12 and in fluid communication with both the compressor 14 and the nozzle 16, and it receives fuel from a source (not shown) and air from the compressor 14 which it combusts in the combustion space to generate the gases of combustion The combustor 15 is defined by an annular outer wall 18, an annular inner wall 20, and a radial wall 22 extending between the outer wall and inner walls 18 and 20 at a location axially opposite the nozzle 16, i.e., at the end of the combustor 15 axially opposite the nozzle 16. As will be described in detail hereinafter, the radial turbine engine 10 also includes means for injecting fuel generally tangentially into a first fuel injection zone 24 adjacent the radial wall 22 and means for injecting fuel generally tangentially into a second fuel injection zone 26 intermediate the first fuel injection zone 24 and the nozzle 16.

Figure 2:
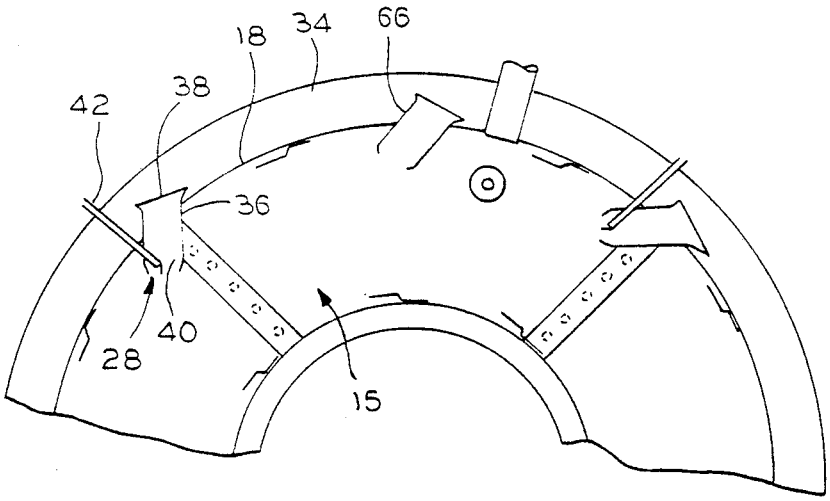
FIG. 2 is a cross-sectional view taken on the line 2—2 of FIG. 1.
Figure 3:
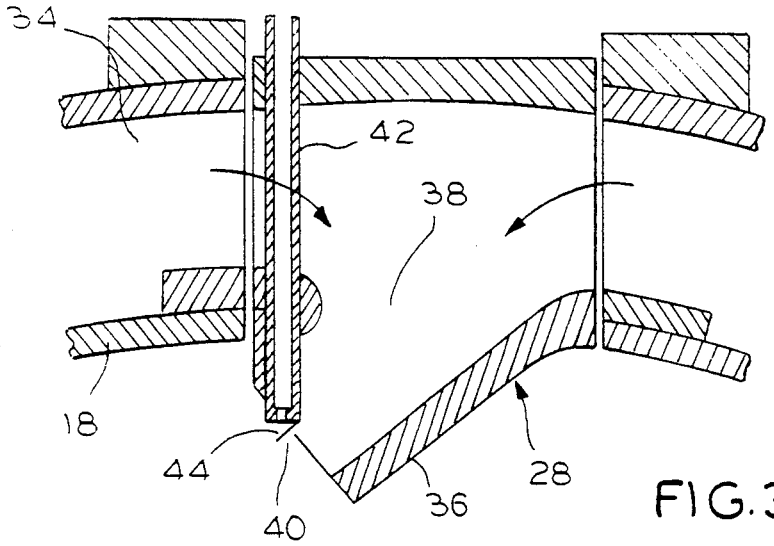
FIG. 3 is a detailed cross-sectional view illustrating a direct impingement fuel injector suitable for at least the first fuel injection zone.

Still referring to FIG. 1, it will be seen that the second fuel injection zone 26 is axially adjacent the first fuel injection zone 24. Also, and now referring to FIGS. 1 through 3, the fuel injecting means comprises a plurality of circumferentially spaced fuel injectors 28 and 30, respectively, wherein the fuel injectors 28 associated with the first fuel injection zone 24 are axially spaced from the fuel injectors 30 associated with the second fuel injection zone 26. As best shown in FIGS. 2 and 3, at least some of the fuel injectors 28 associated with the first fuel injection zone 24 are of the fuel impingement type.

Still referring to FIGS. 1 through 3, the radial turbine engine 10 includes a compressed air inlet 32 leading to an air flow path 34 which extends substantially entirely about the annular combustor 15. It will be seen and appreciated from FIGS. 2 and 3 that the fuel injectors 28 generally comprise an air blast tube 36 mounted in the outer wall 18 so as to be in communication with the air flow path 34. Each of the air blast tubes 36 include an air inlet end 38 and an air/fuel discharge end 40, and they are each arranged so as to inject a fuel air mixture into the annular combustor 15 generally tangentially thereof. As will also be seen, the fuel injectors 28 each include a fuel supply tube 42 having an impingement surface 44 generally at the outlet end 40 of the tube 36.

While the fuel injectors 28 have been shown schematically in FIG. 2, FIG. 3 illustrates one specific form of impingement fuel injector. It will be appreciated that this particular form is not critical to the invention, although it has been found advantageous to utilize some form of impingement fuel injector for some, if not all, of the injectors associated with the first fuel injection zone 24. If desired, the fuel injectors 30 may also be of the impingement type although this is not believed to be necessary in order to achieve the objectives of the invention.

Figure 4:
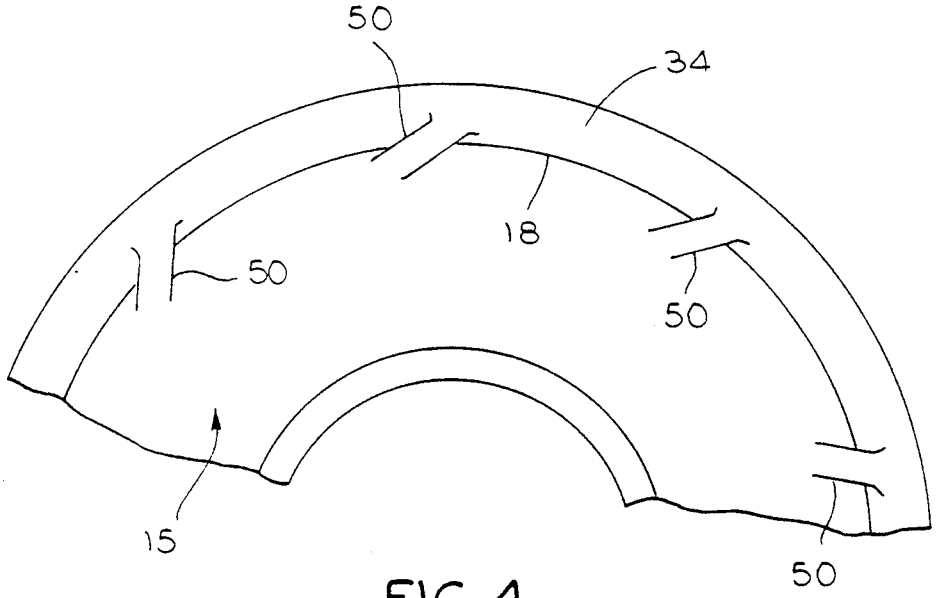
FIG. 4 is a cross-sectional view taken on the line 4—4 of FIG. 1.

Referring now to FIGS. 1 and 4, the radial turbine engine 10 may also include means for injecting dilution air into a dilution air zone at a point intermediate the second fuel injection zone 26 and the nozzle 16. The dilution air zone may advantageously include a first zone 46 adjacent the second fuel injection zone 26 and a second zone immediately upstream of the nozzle 16 and axially adjacent the first zone 46. Generally speaking, the first dilution air zone 46 injects dilution air generally tangentially whereas the second dilution air zone 48 directs dilution air generally toward the nozzle 16.

More specifically, the radial turbine engine preferably includes a plurality of circumferentially spaced tangential dilution air tubes 50 in the outer wall 18 of the combustor 15 in communication with the air flow path 34 for injecting dilution air into the first dilution air zone 46 generally tangentially thereof. Still additionally, the radial turbine engine 10 preferably includes a plurality of circumferentially spaced, inclined dilution air tubes 52 in the outer wall 18 of the combustor 15 in communication with the air flow path 34 for injecting dilution air into the second dilution air zone 48 generally toward the nozzle 16.

Figure 5:
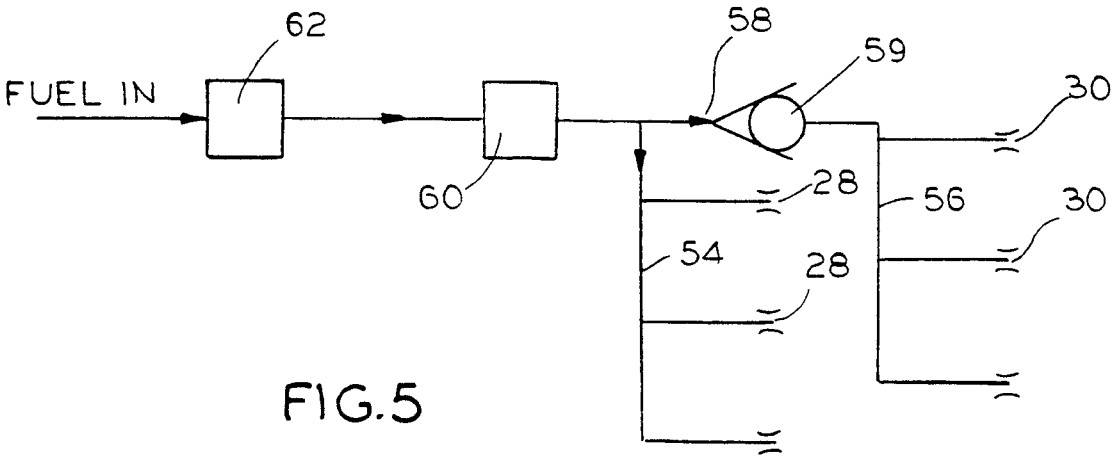
FIG. 5 is a schematic view illustrating a fuel control system for the dual fuel injection zones of the radial turbine engine in accordance with the present invention.

Referring now to FIG. 5, the radial turbine engine 10 may advantageously include means for controlling the distribution of fuel from the source to the respective ones of the fuel injectors 28 and 30. The controlling means advantageously includes first and second fuel manifolds 54 and 56 associated with the fuel injectors 28 and 30 of the first and second fuel injection zones 24 and 26, respectively, as well as a fuel supply line 58 which interconnects the first and second fuel manifolds 54 and 56 and has therein valve means in the form of a check valve 59 for ensuring distribution of fuel from the source first to the first fuel injection zone 24 and then, if sufficient fuel flow is available, to the second fuel injection zone 26. As shown, the controlling means also includes an on/off valve 60 as well as a fuel flow control valve 62 upstream of the first fuel manifold 54 for controlling fuel flow from the source to the first fuel manifold 54 and the check valve 59.

From the foregoing, it should now be appreciated that the first or primary fuel injection zone may comprise a primary flame zone and the second or secondary fuel injection zone may comprise a secondary flame zone. The circumferentially spaced fuel injectors 28 and 30 associated with each of the fuel injection zones 24 and 26 are disposed in the outer wall of the combustor 15 in axially spaced apart planes generally perpendicular to an axis 64 of the combustor 15, and they are both preferably adapted to direct an air/fuel mixture generally tangentially into the combustor 15 in the same direction Similarly, the tangential dilution air tubes 50 are adapted to inject dilution air into the dilution air zone 46 generally tangentially and in the same direction as the injected air/fuel mixture.

In the art, a term commonly employed for sizing a combustor for high altitude operation is the so-called kinetic loading parameter (KLP). Based upon the commonly utilized formula, and by directing half of the fuel flow into the primary flame zone 24 and making appropriate compensation of air flow to maintain the same air/fuel ratio, the KLP is halved. Thus, in the marginal conditions for altitude ignition, a superior environment is provided for stable, efficient combustion.

In addition, and again using standard formulas, the tangential/axial momentum can be doubled when half the fuel flow is directed into the primary flame zone 24. Thus, a higher degree of circumferential mixing of fuel and air is achieved in an arrangement which requires fewer fuel injectors to achieve the required uniformity of circumferential fuel/air mixing. As will be appreciated by those skilled in the combustor art, this is a most advantageous achievement of the present invention in relation to the prior art.

Referring once again to FIGS. 1 and 5, it will be seen that fuel is first delivered to the fuel injectors 28 associated with the first or primary fuel injection or flame zone 24. Several, if not all, of the fuel injectors 28 are preferably of the fuel impingement type, and they are uniformly distributed about the circumference of the combustor 15 substantially as shown in FIG. 2. If desired, the fuel injectors 28 may be alternated with tangential combustion air injection tubes 66 which are mounted in the outer wall 18 of the combustor 15 in communication with the air flow path 34.

As for the use of fuel impingement type of fuel injectors 28, they are much more efficient than swirl pressure atomizing fuel injectors. In swirl pressure atomizing fuel injectors, the fuel is swirling at high velocity in an interior vortex chamber which, in small scale applications, produces high viscous losses which are made far worse when using cold, viscous fuels as required in cold weather starting. Consequently, it is difficult at reduced fuel flow rates, particularly when using viscous fuels, to get sufficient fuel atomization using swirl pressure fuel atomizing injectors.

As a result, at low fuel flow rates, e.g., five pounds per hour, very high fuel pressures are required to achieve good fuel atomization even when using fuels at only moderate viscosities, e.g., four centistokes. At high viscosities, e.g., twenty-five centistokes, it is very difficult to achieve adequate fuel atomization and, furthermore, the high fuel pressure required means that the fuel flow orifices must be very small which makes them expensive to manufacture and enhances their susceptibility to clogging or plug-up Still additionally, such problems are even further compounded because there are usually multiple small orifices per injector which make reliability of performance difficult to achieve As will also be appreciated, the total fuel flow may be very low in a high altitude starting condition, e.g., twenty-five pounds per hour, whereas at full power sea level operation the fuel flow might be, e.g., four hundred fifty pounds per hour. While these parameters are being utilized for purposes of illustration only, it is also useful for purposes of illustration to consider that one hundred pounds per square inch pressure may be necessary for achieving sufficient atomization for altitude ignition. However, if this should be the case, the fuel pressure for full power sea level operation would be on the order of 32,400 pounds per square inch which is an impossibly high fuel pressure.

In order to minimize such excessive fuel pressures, it has been conventional to resort to complex dual orifice or duplex injectors. Such injectors typically have six or more small orifices which increase cost and enhance susceptibility to clogging or plug-up. Furthermore, an expensive flow divider may be needed so as to proportion the fuel between the primary and secondary fuel flow passages.

All of these formidable problems of cost, complexity and unreliability have been entirely avoided by reason of the unique structure and operation of the present invention as described hereinabove. It is believed that very low fuel pressures, e.g., twenty pounds per square inch, can provide excellent fuel atomization for altitude ignition and, by utilizing a low pressure check 59, it is possible to ensure that the required fuel pressure is supplied to the fuel impingement type fuel injectors 28 in the primary flame zone 24 before any fuel can be delivered to the fuel injectors 30. In addition, all the fuel flow may be diverted to the fuel injectors 28 in the primary flame zone 24 to prevent engine overspeed where the load might be instantaneously removed while operating at full power.

By first having established an efficient primary flame zone 24 with a low kinetic loading parameter for effective high altitude operation, the residuum of fuel may then be injected in a downstream, secondary flame zone 26. This is preferably accomplished utilizing tangential air/fuel injection although it need not necessarily be by impingement pressure atomization as the combustion process in the secondary flame zone 26 isn't nearly as critical as that in the primary flame zone 24. As shown in FIG. 1, the first dilution air zone 46 may comprise a burn out zone although this, too, isn't critical to the principles of the present invention.

As also shown in FIG. 1, the second dilution air zone 48 advantageously achieves another important objective of the present invention. Specifically, it permits the maximum amount of combustor length for combustion without having to utilize an excessively long combustor. While particularly advantageous, the dilution air schemes illustrated may be replaced by more conventional dilution air means.

While in the foregoing specification a detailed description of the preferred embodiment has been set forth for purposes of illustration, it will be appreciated that the details herein given may be varied by those skilled in the art without departing from the true spirit and scope of the appended claims.

I claim:

1. A radial turbine engine, comprising:

a turbine wheel coupled to a rotary compressor for axially driven movement thereof;

an annular nozzle for directing gases of combustion radially at said turbine wheel;

an annular combustor defining an annular combustion space disposed about said turbine wheel and in fluid communication with both said compressor and said nozzle, said combustor receiving fuel and air in said combustion space to generate said gases of combustion, said annular combustor being defined by an annular outer wall, an annular inner wall, and a radial wall extending between said inner and outer walls axially opposite said nozzle; and means for injecting fuel tangentially through said outer wall into a first fuel injection zone adjacent said radial wall and through said outer wall into a second fuel injection zone intermediate said first fuel injection zone and said nozzle.

2. The radial turbine engine of claim 1 wherein said second fuel injection zone is axially adjacent said first fuel injection zone.

3. The radial turbine engine of claim 1 wherein said fuel injecting means comprise a plurality of circumferentially spaced fuel injectors.

4. The radial turbine engine of claim 3 wherein said fuel injectors associated with said first and second fuel injection zones are axially spaced.

5. The radial turbine engine of claim 4 wherein at least said fuel injectors associated with said first fuel injection zone are of the fuel impingement type.

6. The radial turbine engine of claim 1 including means for controlling distribution of fuel from said source to the respective ones of said fuel injecting means.

7. The radial turbine engine of claim 6 wherein said controlling means includes valve means for ensuring distribution of fuel from said source first to said first fuel injection zone.

8. The radial turbine engine of claim 1 including means for injecting dilution air into a dilution air zone at a point intermediate said second fuel injection zone and said nozzle.

9. The radial turbine engine of claim 8 wherein said dilution air zone includes a first zone adjacent said second fuel injection zone and an axially adjacent second zone immediately upstream of said nozzle.

10. A radial turbine engine, comprising:

a turbine wheel coupled to a rotary compressor for axially driven movement thereof;

an annular nozzle for directing gases of combustion radially at said turbine wheel;

an annular combustor defining an annular combustion space disposed about said turbine wheel and in fluid communication with both said compressor and said nozzle, said combustor receiving fuel from a source and air from said compressor and combusting fuel and air in said combustion space to generate said gases of combustion, said annular combustor being defined by an annular outer wall, an annular inner wall, and a radial wall extending between said inner and outer walls axially opposite said nozzle;

means for injecting fuel tangentially through said outer wall into a first fuel injection zone adjacent said radial wall and through said outer wall into a second fuel injection zone intermediate said first fuel injection zone and said nozzle, said second fuel injection zone being axially adjacent said first fuel injection zone and said fuel injecting means comprising a plurality of circumferentially spaced fuel injectors associated with each of said fuel injection zones; and means for controlling distribution f fuel from said source to the respective ones of said fuel injectors.

11. The radial turbine engine of claim 10 wherein said fuel injectors associated with said first and second fuel injection zones are axially spaced.

12. The radial turbine engine of claim 11 wherein at least said fuel injectors associated with said first fuel injection zone are of the fuel impingement type.

13. The radial turbine engine of claim 10 wherein said controlling means includes valve means for ensuring distribution of fuel from said source first to said first fuel injection zone.

14. The radial turbine engine of claim 10 including means for injecting dilution air into a dilution air zone at a point intermediate said second fuel injection zone and said nozzle.

15. The radial turbine engine of claim 14 wherein said dilution air zone includes a first zone adjacent said second fuel injection zone and an axially adjacent second zone immediately upstream of said nozzle.

16. A radial turbine engine, comprising:

a turbine wheel coupled to a rotary compressor for axially driven movement thereof;

an annular nozzle for directing gases of combustion radially at said turbine wheel;

an annular combustor defining an annular combustion space disposed about said tubular wheel and in fluid communication with both said compressor and said nozzle, said combustor receiving fuel from a source and air from said compressor and combusting fuel and air in said combustion space to generate said gases of combustion, said annular combustor being defined by an annular outer wall, an annular inner wall, and a radial wall extending between said inner and outer walls axially opposite said nozzle;

means for injecting fuel tangentially through said outer wall into a first fuel injection zone adjacent said radial wall and through said outer wall into a second fuel injection zone intermediate said first fuel injection zone and said nozzle, said second fuel injection zone being axially adjacent said first fuel injection zone and said fuel injecting means comprising a plurality of circumferentially spaced fuel injectors associated with each of said fuel injection zones wherein at least said fuel injectors associated with said first fuel injection zone are of the fuel impingement type, said circumferentially spaced fuel injectors associated with each of said fuel injection zones being disposed in said outer wall of said combustor in axially spaced part planes generally perpendicular to an axis of said combustor;

means for controlling distribution of fuel from said source to the respective ones of said fuel injectors; and means for injecting dilution air into a dilution air zone intermediate said second fuel injection zone and said nozzle.

17. The radial turbine engine of claim 16 wherein said controlling means includes valve means for ensuring distribution of fuel from said source first to said first fuel injection zone.

18. The radial turbine engine of claim 17 wherein said controlling means includes first and second fuel manifolds associated with said fuel injectors of said first and second fuel injection zones, respectively.

19. The radial turbine engine of claim 18 including a fuel supply line interconnecting said first and second fuel manifolds and said valve means comprises a check valve disposed in said fuel supply line.

20. The radial turbine engine of claim 19 wherein said controlling means includes a control valve upstream of said first fuel manifold for controlling fuel flow from said source to said first fuel manifold.

21. The radial turbine engine of claim 16 wherein said dilution air zone includes a first zone adjacent said second fuel injection zone and an axially adjacent second zone immediately upstream of said nozzle.

22. The radial turbine engine of claim 21 including a plurality of circumferentially spaced tangential dilution air tubes in said outer wall of said combustor for injecting dilution air into said first dilution air zone generally tangentially.

23. The radial turbine engine of claim 21 including a plurality of circumferentially spaced inclined dilution air tubes in said outer wall of said combustor for injecting dilution air into said second dilution air zone generally toward said nozzle.

* * * * *